United States Patent [19]

Seshamani

[11] Patent Number: 4,607,690

[45] Date of Patent: Aug. 26, 1986

[54] TUBE AND SUPPORT SYSTEM FOR A HEAT EXCHANGER

[75] Inventor: Venkatraman Seshamani, Gillete, N.J.

[73] Assignee: Foster Wheeler Energy Corporation, Livingston, N.J.

[21] Appl. No.: 802,913

[22] Filed: Nov. 29, 1985

[51] Int. Cl.[4] ..... F22B 37/20; F28D 7/08; F28F 9/26

[52] U.S. Cl. ..... 165/145; 122/510; 165/162

[58] Field of Search ..... 165/162, 172, 145, 150, 165/67; 122/510

[56] References Cited

U.S. PATENT DOCUMENTS

| | | | |
|---|---|---|---|
| 528,388 | 10/1894 | Phillips | 122/4 |
| 2,380,169 | 7/1945 | Gygi | 110/263 X |
| 3,055,348 | 9/1962 | Brash | 122/510 |
| 3,277,958 | 10/1966 | Taylor et al. | 165/145 |
| 3,523,761 | 8/1970 | Graham | 422/200 |
| 3,545,409 | 12/1970 | Young | 122/510 X |
| 3,547,187 | 12/1970 | Cook et al. | 165/145 X |
| 3,665,893 | 5/1972 | Barberton et al. | 122/510 X |
| 3,982,901 | 9/1976 | Steever et al. | 422/143 |
| 4,208,988 | 6/1980 | Jacobs et al. | 122/510 |
| 4,211,186 | 7/1980 | Pearce | 122/4 D |
| 4,240,377 | 12/1980 | Johnson | 122/4 D |
| 4,377,072 | 3/1983 | Campbell, Jr. et al. | 165/145 X |

FOREIGN PATENT DOCUMENTS

| | | | |
|---|---|---|---|
| 341684 | 4/1904 | France | 165/172 |
| 780061 | 7/1957 | United Kingdom | 165/172 |
| 842828 | 7/1960 | United Kingdom | 165/172 |

*Primary Examiner*—Sheldon J. Richter

*Attorney, Agent, or Firm*—Marvin A. Naigur; John E. Wilson; Warren B. Kice

[57] ABSTRACT

A tube and support system for a heat exchanger in which a first and second series of spaced tubes extend from opposite sides of a header. Each tube extends in a serpentine pattern, with the tubes of the first series being offset from the tubes of the second series. Each tube in one of the series is bent in a manner to extend in a same plane as the other series of tubes. A support member extends between the bent tube portions and the corresponding portions of the tubes of the other series.

3 Claims, 5 Drawing Figures

TUBE AND SUPPORT SYSTEM FOR A HEAT EXCHANGER

The present invention relates to a tube and support system for a heat exchanger, and more particularly, to a heat exchange tube and support arrangement for extending above the furnace section of a boiler, or the like.

The use of fluidized beds has been recognized as an attractive means of generating heat in a heat exchanger such as a boiler, a combustor, a gasifier, a steam generator or the like. In these arrangements, air is passed through a bed of particulate material which normally consists of a mixture of inert material and a fossil fuel, such as coal, to fluidize the bed and to promote the combustion of the fuel. When the heat produced by the fluidized bed is utilized to convert water to steam such as in a steam generator, for example, the fluidized bed system offers an attractive combination of high heat release, improved heat transfer to surfaces within the bed and compact size.

In these type arrangements, a plurality of heat exchange tubes are usually disposed in, or immediately above the fluidized bed for circulating a cooling fluid, such as water, to remove the heat generated by the bed to an external location. The tubes are connected to an external inlet header and extend in a serpentine relationship within the housing of the heat exchanger. The tubes are normally supported in an elevated position slightly above the grid plate of the heat exchanger by a refractory pier support, or the like, and are supported only at their juncture with the furnace walls, since intermediate supports are both expensive and tend to block the flow of combustion gases and air from the fluidized bed upwardly through the furnace. This thus limits the width, or span, of the tubes between the opposed furnace walls and thus limits the capacity of the boiler.

SUMMARY OF THE INVENTION

It is therefore an object of the present invention to provide a tube and support system for a fluidized bed boiler in which the heat exchange tubes are of increased length and span a greater width.

It is a further object of the present invention to provide the system of the above type in which the individual tubes are self supported, i.e., they are supported relative to one another at points intermediate their juncture with the furnace walls.

Toward the fulfillment of these and other objects, the tube and support system of the present invention features a first and second series of spaced tubes extending from opposite sides of a header with each of the tubes extending in a serpentine pattern. The tubes of the first series are offset from the tubes of the second series and a portion of each tube in the first series is bent in a manner to extend in the same plane as the other series of tubes. A support member extends between the bent portions of the first series of tubes and the corresponding portions of the other series.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
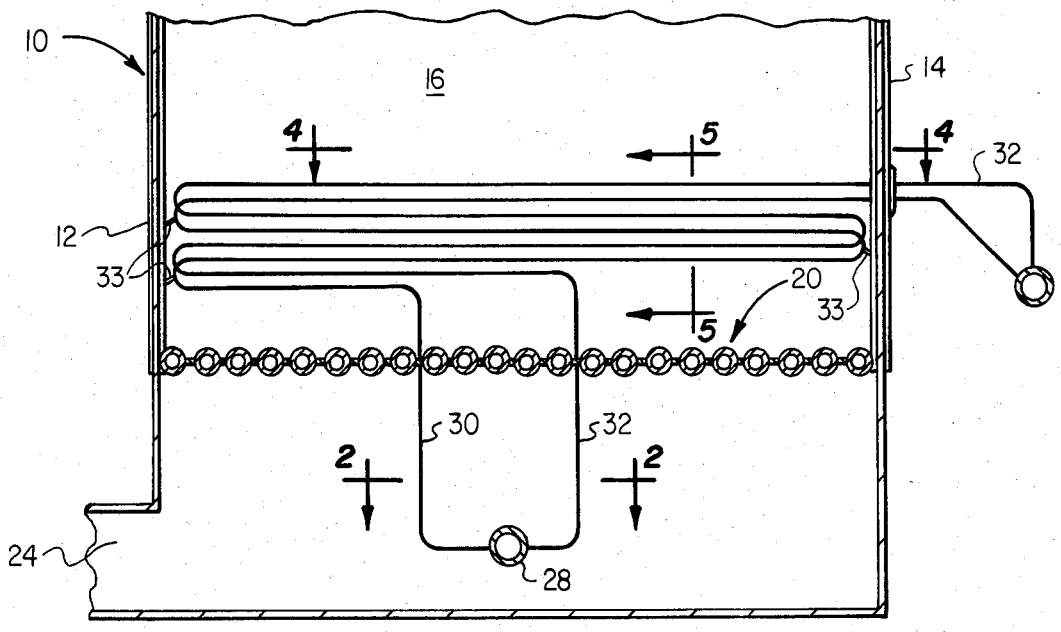
FIG. 1 is a vertical sectional view of a portion of a fluidized bed boiler.

Referring specifically to FIG. 1 of the drawings, the present invention will be described in connection with a fluidized bed boiler, shown in general by the reference numeral 10, and consisting of a front wall 12, a rear wall 14, and two sidewalls, one of which is shown by the reference numeral 16. The upper portion of the boiler is not shown for the convenience of presentation, it being understood that it consists of a convection section, a roof and an outlet for allowing the combustion gases to discharge from the boiler in a conventional manner.

A grid assembly 20 is disposed in the lower portion of the boiler and supports a bed of particulate material (not shown) which can consist of a mixture of discrete particles of inert material and fuel material, such as bituminous coal, which are introduced into the bed through feeders or the like (not shown) extending through one of the sidewalls 16.

An air plenum chamber 22 is provided immediately below the grid assembly 20 and communicates with an air inlet 24 provided through the front wall 12 for distributing air from an external source (not shown) to the chamber 22.

Figure 2:
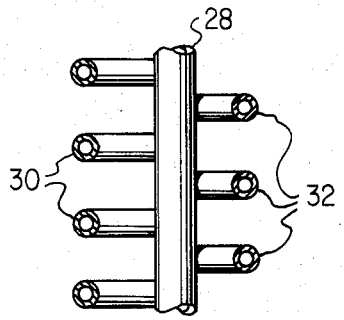
FIG. 2 is a cross-sectional view taken along the line 2—2 of FIG. 1.

As shown in FIGS. 1 and 2, a horizontally extending header 28 is provided in the air plenum chamber 22 and has a first series of tubes 30 extending from one side thereof and a second series of tubes 32 extending from an opposite side thereof. The second series of tubes 32 are offset from the first series of tubes 30 in a horizontal direction for reasons that will be apparent. The tubes 30 and 32 extend horizontally from the header 28 and then vertically upwardly through the plate assembly 20 and into the bed of particulate material supported by the grid plate 20. The portions or the tubes 30 and 32 extending above the grid assembly are bent horizontally into a serpentine pattern to extend between the front wall 12 and the rear wall 14 in a manner to be discussed. Two rows and one row of support lugs 33 extend from the front wall 12, and the rear wall 14, respectively, and support the tubes 30 at their bends.

Figure 3:
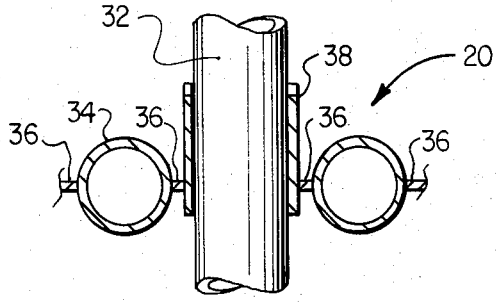
FIG. 3 is an enlarged, sectional view of a portion of the structure of FIG. 1.

As shown in FIG. 3, the plate assembly 20 is formed by a plurality of horizontal tubes 34 disposed in a spaced, parallel relationship and connected by flanges 36 extending from diametrically opposite portions thereof. A plurality of spaced openings are formed in two of the flanges 36 for receiving a corresponding number of support sleeves 38 which, in turn, receive the tubes 30 and 32. It is understood that, although only four tubes 30 and three tubes 32 are shown in FIG. 2, the header 28 spans the entire distance between the sidewalls 16 and a corresponding number of tubes 30 and 32 extend along the length of the header and through the grid assembly 20.

As better shown in FIG. 1, the tubes 30 are also offset from the tubes 32 in a vertical direction to prevent interference between the respective tubes as they bend back and forth between the front wall 12 and the rear wall 14. The offset is such that the horizontal portions of the tubes 30 extend underneath the corresponding portions of the tubes 32 as shown in FIG. 1.

Figure 4:
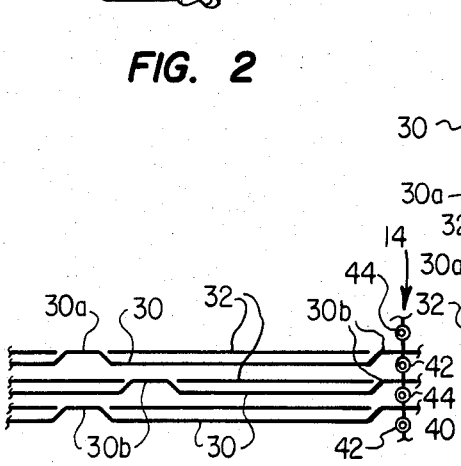
FIG. 4 is a schematic top plan view of a portion of the heat exchange tubes shown in FIG. 1.
Figure 5:
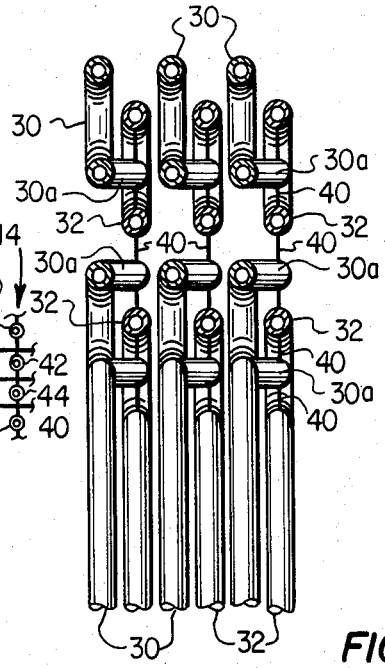
FIG. 5 is a cross-sectional view taken along the line 5—5 of FIG. 1.

According to a main feature of the present invention, and as better shown in FIGS. 1, 4 and 5, selected portions of the horizontal portions of the tubes 30 are bent into the plane of the tubes 32 so that the bent portions extend immediately underneath corresponding portions of the tube 32. More particularly, as shown in FIGS. 4 and 5, each tube 30 has a bent portion 30*a* which is bent into the plane of the corresponding tube 32 so that the bent portion is directly underneath the latter tube portion.

As shown in FIG. 5, a support lug 40 extends between each bent portion 30*a* of the tubes 30 and the corresponding portion of the tubes 32 extending immediately above the bent portions. The support lugs 40 may be secured to the two tube portions in any conventional manner such as by welding. Alternatively, the support lugs 40 can be in the form of slip spacers which are not shown in detail since they are well known in the art.

Referring again to FIG. 1, the bent tube portions 30*a* and the support lugs 40 are spaced from the walls 12 and 14 respectively, a distance corresponding to approximately one-third the length of each horizontal section of the tubes 30 and 32.

As a result of the foregoing, the horizontal sections of the tubes 30 and 32 are self supporting, i.e., the respective tube sections can be made relatively long without requiring any external supports to prevent sagging.

Referring again to FIG. 4, it is noted that the portions of the walls 12 and 14 extending above the grid assembly 20 are formed by a plurality of waterwall tubes 42 which extend in a spaced parallel relationship for the length of the furnace and are connected by a plurality of elongated flanges 44 extending from diametrically opposed portion of the tubes to render the wall thus formed airtight.

The end portions 30*b* of the upper sections of the tubes 30 adjacent to the wall 14 are bent in the same manner as discussed above into a plane immediately below the corresponding upper sections of tubes 30 so that both the tubes 30 and 32 of the same series penetrate the same flange 44.

It is thus seen that the arrangement of the present invention, a greater width of furnace section to be utilized utilizing relatively long horizontal tube sections without any external support system.

It is understood that several variations may be made in the foregoing without departing from the scope of the invention. For example, the heat exchanger tubes are not limited to use in a fluidized bed boiler, but rather can be used in any type of heat exchanger.

Other modifications, changes and substitutions are intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A tube and support system for a heat exchanger comprising a header, a first series of spaced tubes extending from one side of the header, a second series of spaced tubes extending from the other side of the header, each of the tubes extending in a serpentine pattern with the tubes of said first series being offset from the tubes of said second series, each tube in one of said series being bent in a manner to extend in a same plane as said other series of tubes, and a support member extending between said bent portions of said one series of tubes and corresponding portions of said other series of tubes.

2. The system of claim 1 wherein said tubes of said first series are offset from the tubes of said second series in two directions.

3. The system of claim 1 wherein said one series of tubes is bent back out of said plane.

* * * * *